US012644400B2

(12) United States Patent
Hudnall et al.

(10) Patent No.: US 12,644,400 B2
(45) Date of Patent: Jun. 2, 2026

(54) ENGINE OILING SYSTEM

(71) Applicant: Holley Performance Products, Inc., Bowling Green, KY (US)

(72) Inventors: Coy Hudnall, Bowling Green, KY (US); Kevin Tracy, Port Charlotte, FL (US)

(73) Assignee: Holley Performance Products, Inc., Bowling Green, KY (US)

( * ) Notice: Subject to any disclaimer, the term of this patent is extended or adjusted under 35 U.S.C. 154(b) by 38 days.

(21) Appl. No.: 18/516,153

(22) Filed: Nov. 21, 2023

(65) Prior Publication Data

US 2024/0167402 A1 May 23, 2024

Related U.S. Application Data

(60) Provisional application No. 63/427,649, filed on Nov. 23, 2022.

(51) Int. Cl.

| | |
|---|---|
| ***F01M 11/00*** | (2006.01) |
| ***F01M 1/02*** | (2006.01) |
| ***F04C 2/10*** | (2006.01) |
| ***F04C 15/00*** | (2006.01) |

(52) U.S. Cl.

CPC ..... *F01M 11/0004* (2013.01); *F01M 1/02* (2013.01); *F04C 2/10* (2013.01); *F04C 15/0057* (2013.01); *F01M 2001/0269* (2013.01); *F01M 2001/0284* (2013.01); *F01M 2011/0062* (2013.01)

(58) Field of Classification Search

CPC ..... F01M 11/0004; F01M 1/02; F01M 2001/0269; F01M 2001/0284; F01M 2011/0062; F04C 2/10; F04C 15/0057

See application file for complete search history.

(56) References Cited

U.S. PATENT DOCUMENTS

| | | | | |
|---|---|---|---|---|
| 5,373,892 | A * | 12/1994 | Johnson | F01M 1/12 165/41 |
| D660,892 | S | 5/2012 | Tomlinson | |
| D842,911 | S | 3/2019 | O'Neill | |
| D979,622 | S | 2/2023 | Hudnall | |
| 11,661,869 | B1 | 5/2023 | Hudnall | |
| D1,046,922 | S | 10/2024 | Hudnall | |
| D1,059,448 | S | 1/2025 | Hudnall | |

(Continued)

FOREIGN PATENT DOCUMENTS

| | | |
|---|---|---|
| AU | 341123 | 2/2012 |
| AU | 201717295 | 12/2017 |

(Continued)

OTHER PUBLICATIONS

Youtube: 7.3L Godzilla Swap Solutions—Oil Pump, Pan, Front Cover & Accessories, Intake & More for Ford's V8, URL: https://www.youtube.com/watch?v=xHPXikbOork; Published May 5, 2021 [Retrieved from internet Nov. 17, 2023].

(Continued)

*Primary Examiner* — Syed O Hasan

(74) *Attorney, Agent, or Firm* — Brooks Kushman P.C.

(57) ABSTRACT

Present embodiments relate to an engine oiling system. More specifically, but without limitation, present embodiments relate to an engine oiling system which provides a lower profile for the engine within the engine compartment.

18 Claims, 5 Drawing Sheets

(56) References Cited

U.S. PATENT DOCUMENTS

| | | | | |
|---|---|---|---|---|
| D1,059,449 | S | 1/2025 | Hudnall | |
| 2005/0081815 | A1* | 4/2005 | Ohta | F01M 11/0004 123/196 R |
| 2016/0003240 | A1* | 1/2016 | Yu | F04C 14/26 418/206.1 |
| 2018/0030867 | A1* | 2/2018 | Honda | F01M 11/00 |
| 2018/0245587 | A1* | 8/2018 | Nishida | F04C 14/226 |
| 2024/0167402 | A1 | 5/2024 | Hudnall | |

FOREIGN PATENT DOCUMENTS

| | | |
|---|---|---|
| AU | 201717297 | 12/2017 |
| AU | 201717299 | 12/2017 |

OTHER PUBLICATIONS

Moroso; Oil Pump, Chrysler Gen 3 Hemi 09-Up, STD vol, High Pressure; Estimated publication: Oct. 1, 2008 [Retrieved from internet Nov. 17, 2023].

Melling; 1.26.22 New Oil Pump & Screen for RAM 6.4L OHV Hemi—#M462-388S; Published Jan. 26, 2022; URL: https://www.melling.com/1-26-22-new-oil-pump-screen-for-ram-6-4l-ohv-hemi-m462-388s/ [Retrieved from internet Nov. 17, 2023].

Design U.S. Appl. No. 29/980,220, filed Dec. 23, 2024 titled Oil Pan.

Design U.S. Appl. 29/979,152, filed Dec. 17, 2024 titled Oil Pan.

U.S. Appl. No. 63/427,649, filed Nov. 23, 2022 titled Engine Oiling System.

* cited by examiner

ENGINE OILING SYSTEM

CLAIM TO PRIORITY

This non-provisional patent application claims priority to and benefit of, under 35 U.S.C. § 119(e), U.S. Provisional Patent Application Ser. No. 63/427,649, filed Nov. 23, 2022, all of which is incorporated by reference herein.

BACKGROUND

1. Field of the Invention

Present embodiments relate to an engine oiling system. More specifically, but without limitation, present embodiments relate to an engine oiling system which provides a lower profile for the engine within the engine compartment.

2. Description of the Related Art

Later model automotive engines are more efficient, have less emissions, and often better performance than engines of the past. It is sometimes desirable to swap these newer engines into older vehicle applications. Later engines, because of incorporated technology, are often larger than the engine being removed in the older vehicle. The Ford 7.3-liter gasoline combustion engine is one example. Where a larger engine is swapped into a vehicle that did not contemplate such, accommodations are often needed so the swap engine may be used while maintaining a stock appearance to the vehicle.

When the swap engine does not properly fit into a vehicle engine compartment, this can result in a hood which does not properly close. There are several possible modifications. For example, one option is to modify or replace the hood to accommodate the larger swap engine height. Another option is to modify or change the lower restrictive K-member. A still further option is to decrease the distance from the engine's bottom to the crankshaft to reduce the overall height. One difficulty with this solution is that the engine oil pan may have mechanical structures therein which limit or preclude shape changes to the pan.

It would be desirable to provide an engine retrofit that lowers the overall height of the engine and precludes the need to cut a hole in a hood or make other modifications changing the external appearance of the vehicle, and so that the hood closes appropriately.

The information included in this Background section of the specification, including any references cited herein and any description or discussion thereof, is included for technical reference purposes only and is not to be regarded as subject matter by which the scope of the invention is to be bound.

SUMMARY

The present application discloses one or more of the features recited in the appended claims and/or the following features which alone or in any combination, may comprise patentable subject matter.

Present embodiments relate to an engine oiling system. The oiling system allows a decrease in total engine height and orientation of the engine which allows use of the engine in a larger variety of vehicles with smaller height dimensions in the engine compartment. The oiling system provides an oil pump. The embodiments incorporate a directly driven front oil pump and incorporated cast-in passages in the oil pan to eliminate the restrictive, previously required oil pump drive shaft. Further, the result is a decreased distance from the oil pan and its respective silhouette to the crankshaft. The result is an engine assembly that can be retrofitted into more vehicle applications while maintaining the original and typically optimal engine inclination.

According to some embodiments, an oiling system for a combustion engine may comprise a timing cover, an oil pump which is mounted to said timing cover, said oil pump being a gerotor pump that is capable of being directly driven by a crankshaft. An oil pan having a first end connected to a lower edge of said timing cover, a second end defining a sump, and integrally formed oil passages extending between the first end and the second end. The oil pump may be disposed adjacent to the first end of said oil pan and in fluid communication with the oil passages.

In some embodiments, the oiling system may further comprise the passages being cast-in oil passages in the oil pan. In some embodiments, the cast-in oil passages may be in flow communication with ports of the oil pump. The oiling system may further comprise a gasket disposed between the cast-in ports of the oil pump and cast-in passages of the oil pan.

In some embodiments, the oil pump may be disposed on a rear side of the timing cover.

In some embodiments, the oiling system may further comprise an access port formed in the oil pump.

In some embodiments, the oil pan may have an external access for an oil pump pressure control.

In some embodiments, the pump may be positioned for and capable of being driven by a crankshaft of said combustion engine.

In some embodiments, the pump may be directly driven by the crankshaft.

In some embodiments, the oiling system may further comprise an adapter positioned within the pump and capable of receiving the crankshaft. The adapter may cause rotation of the pump at a same speed of the crankshaft.

In some embodiments, the combustion engine may be a FORD 7.3 L gasoline engine.

In some embodiments, the oiling system may further comprise a drive or adapter on the crankshaft engaging the oil pump.

In some embodiments, the oil pump may comprise a housing and first and second internal rotors.

In some embodiments, the oil pan may further comprise a windage tray.

According to some embodiments, a method of installing an oiling system may comprise the steps of removing an first oil pan and a first timing cover from a combustion engine, installing an oil pump to a second timing cover or a second oil pan, said second oil pan having reduced depth dimension, connecting the oil pump to ports in the oil pan, the ports being in fluid communication with the oil passages in the oil pan, and, installing the oil pan to the combustion engine.

In some embodiments, the method may further comprise driving the oil pump with a crankshaft of the combustion engine. The combustion engine may be a FORD 7.3 L gasoline engine.

In some embodiments, the oil pump may be directly driven.

In some embodiments, the oiling system may be a front drive system.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments may be better understood, embodiments of an engine oiling system will now be described by way of examples. These embodiments are not to limit the scope of the claims as other embodiments of an engine oiling system will become apparent to one having ordinary skill in the art upon reading the instant description. Non-limiting examples of the present embodiments are shown in figures wherein:

DETAILED DESCRIPTION

Figure 1B:
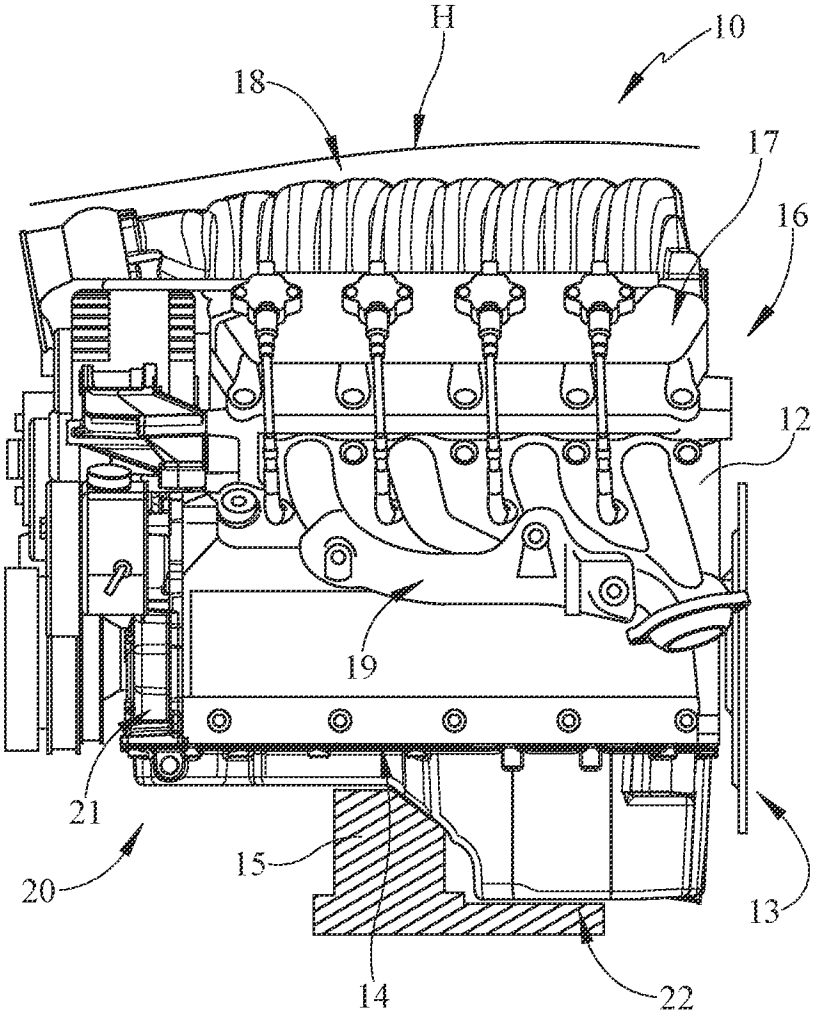
FIG. 1B is a second side view of an engine with an oiling system according to present embodiments.

It is to be understood that an engine oiling system is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Referring now to FIGS. 1-7, an engine oiling system is provided which converts a rear mount oiling system to a front mount and additionally reduces the total mounting height of the installed engine by reducing the sump vertical dimension. The instant oiling system reduces the needed height dimensions for engine compartments, making the engine more versatile for use in more vehicles. Further, the intake geometry may be altered which also improves versatility of the engine and use in smaller engine bays, reducing interference with the hood. Additionally, by changing the rear mount oiling system to front mount, the oil pump may be directly driven, simplifying an otherwise more complicated need to provided pump driving components to the rear oil pump. All of this provides an overall engine height reduction and improves intake geometry.

Figure 1A:
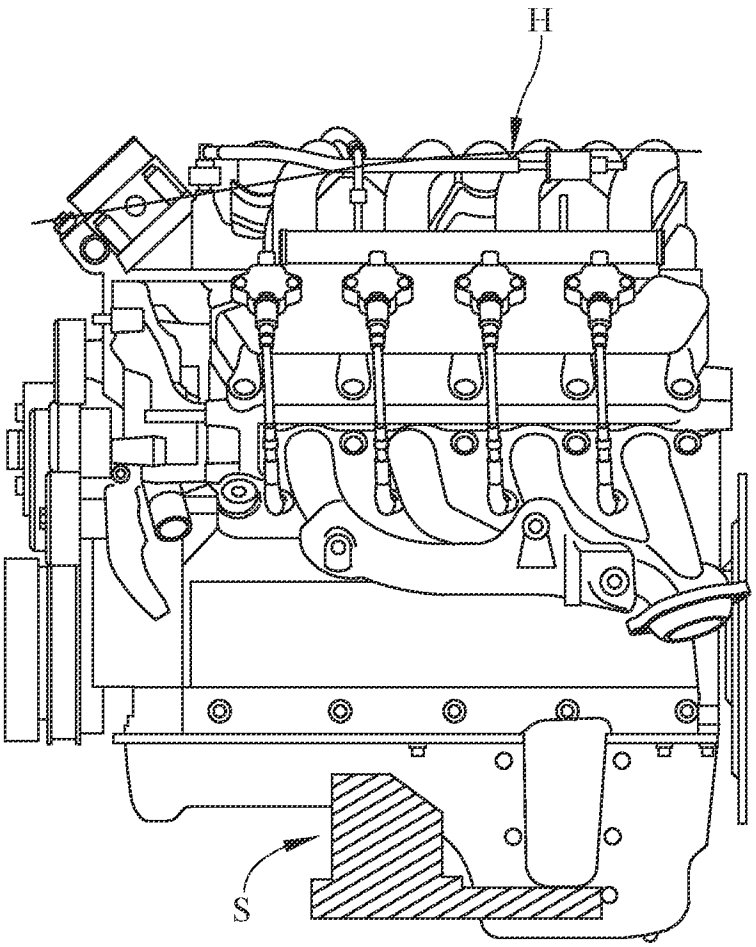
FIG. 1A Prior Art
FIG. 1A is a first side view of an engine with prior art oiling system.

Referring now to FIG. 1A, a motor is shown with a prior art oiling system. The prior art oiling system and the engine comprise a height that interferes with a hood H. It is desirable that the overall height of the engine be reduced so that the engine can fit into an engine compartment of cars with smaller compartment size/height.

The instant engine arrangement for the 7.3 L Ford has additional complication related to the oil pan and structures therein. The engine has an oiling system that includes a drive shaft in the oil pan under the engine block that engages an oil pump in the sump of the oil pan, spaced away from the front of the oil pan. This shaft is connected to the crankshaft with a gear and chain assembly. This drive system powers the oil pump which is actually integrated into the oil pan itself. This oiling system prevents moving the oil pan profile closer to the crankshaft and engine and is thus one limiting factor in use of the engine in smaller engine components.

At the upper side of the engine, the hood H is shown represented by a line that is interfering with the intake of the depicted engine. Likewise, at the bottom, a support member S within the compartment area is shown interfering with the depicted oil pan.

With reference additionally to FIG. 1B, an engine 10 is shown with an oiling system 20. The engine 10 may be, for example in some embodiments, a Ford 7.3 L combustion engine. However, the concepts and teaching may be applicable to other engines. The engine 10 comprises generally an engine block 12, a cylinder or engine head, at least one valve cover 17 and an exhaust manifold 19 and an air intake 18 on an upper side of the engine 10. The oiling system 20 reduces the total height of the engine 10 thus allowing use of the engine 10 in smaller engine compartments, and therefore adding versatility to the engine. The air intake 18 is shown with an altered geometry to reduce the clearance needed for the hood H. Specifically, at the forward end of the intake 18, the flange connection is directed forward and slightly downward rather than upward as shown in FIG. 1A, to reduce the total height needed for the engine 10.

The engine 10 is shown in assembled form and in side view. The engine block 12 may have a plurality of cylinders (not shown) formed therein. The engine 10 may be, for non-limiting example, a four cylinder, six cylinder, or an eight cylinder engine. At one end 16 of the engine block 12, a transmission may be connected by clutch or torque converter 13 and along a bottom 14 of the engine block 12, the oil pan assembly 22 may be located. The oiling system 20 is defined by a timing cover 21 and the oil pan assembly 22. The timing cover 21 is located at the left hand side of the engine 10 in the view depicted and along the front of the engine block 12, and the oil pan assembly 22 is located along bottom of the engine block 12. The location of the oil pan assembly 22, however, is not limited to the bottom 14 and may be at other locations depending on the configuration of the engine block 12 and the engine design.

The engine block 12 and other parts associated with the engine 10 and oiling system 20 may have a plurality of lubricating passages through which oil is pumped. Upon circulating through the engine 10, and lubricating parts, the oil returns to the oil pan assembly 22. The oiling system 20 comprises the oil pan assembly 22 and the timing cover 21, which may also be referred to as an engine front cover or a timing gear cover.

In the present embodiments, the oiling pan assembly 22 better allows for fitment relative to a support member 15, also referred to as a K-member 15. The K-member 15 is generally understood by one skilled in the art as a structural member of a chassis which may or may not be removable. In some embodiments, it may attach to the frame rails and pass under the engine. The K-member 15 may also be used to mount front suspension components.

As shown by comparison with FIG. 1A, the prior art oil pan does not clear the K-member with optimal engine inclination relative to other respective components. Alternately, in FIG. 1B, the oil pan assembly 22 clears the K-member 15. As a result of this clearance, the total required height for the engine compartment is reduced, because the engine can sit lower in the engine compartment. Even further, hoods H of some vehicles may close, where they would not do so in the prior art arrangement.

Figure 2:
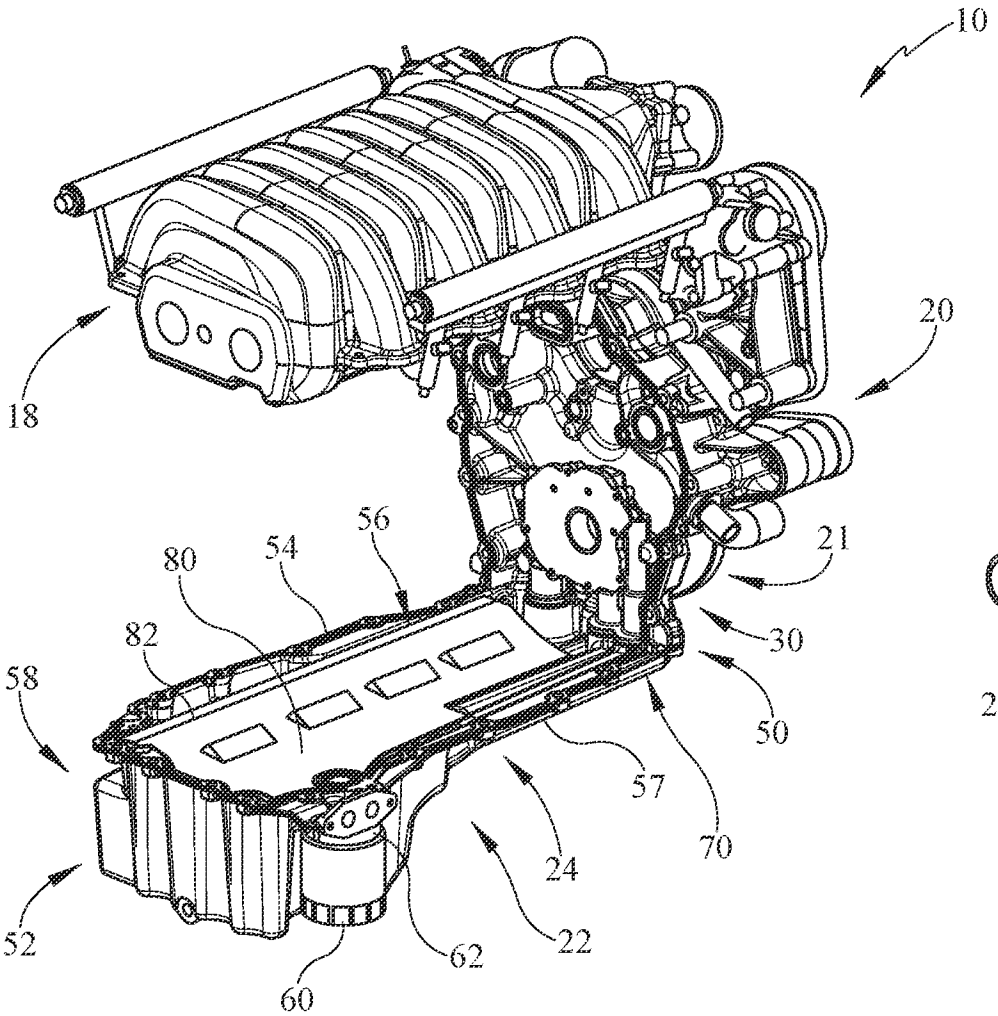
FIG. 2 is a rear perspective view of the oiling system of FIG. 1B removed from portions of the engine.

Referring now to FIG. 2, the oiling system 20 is shown removed from a majority of the remainder of the engine 10 (FIG. 1B), specifically the engine block 12 (FIG. 1B) and exhaust manifold 19 (FIG. 1B). The oiling system 20 includes the oil pan assembly 22 that fastens to the bottom 14 (FIG. 1B) of the engine block 12. The oil pan assembly 22 comprises an oil pan 24 is generally located beneath an engine crankshaft. The oil pan 24 provides a recovery location for oil moving through the engine 10 and a sump 26 wherein the oil gathers. From the sump 26, oil is moved to an oil pump 30 for pumping through the engine 10 to repeat the cycle.

The oil pan 24 has a forward end 50 corresponding to a forward end of the engine 10 when located in the vehicle and an opposite rear end 52. The forward end 50 of the oil pan 24 may comprise connections 70 for the oil pump 30, for example cast connections, and further provides a fluid connection for cast-in conduits to feed the pump 30 located at the forward end 50 of the oil pan 24. The conduits 64 (FIG. 5) and the connections 70 may be cast-in, may be fabricated metal structures, or may be plumbed with hoses external to the oil pan 24.

In the instant embodiment, the sump 26 is located at the rear end 52 of the oil pan 24. While the oil pan 24 is shown as a rear-sump oil pan, alternatively the oil pan 24 may also be a front sump or mid sump embodiment as well. The oil pan 24 has a long dimension and short dimension defining a generally rectangular shape at an upper periphery of the oil pan 24. The oil pan 24 may be cast, stamped, or forged for example. The oil pan 24 comprises a flange or lip 54 that surrounds an upper opening 56, and a body 58 defined by a plurality of sidewalls 57 depending from the flange or lip 54. As will be seen, the oil pan 24 may have one or more upper levels and the sump 26 as shown.

The oil pan 24 may include an oil filter mount 62 and an oil filter 60 is shown in the depicted embodiment. The oil filter 60 may be in fluid communication with oil entering the oil pan 24 or oppositely may be in fluid communication with oil being pumped from the oil pan 24. The oil flows generally from the sump 26, to the pump 30, to the filter 60, and through the engine 10 before returning to the oil pan 24.

The oil pan 24 has an upper opening and may or may not have a windage tray 80 extending across the opening 56 of the oil pan 24. The windage tray 80 is shown first and covers an upper opening 56 in the oil pan 24. The windage tray 80 limits force effects within the oil pan 24 created by the crank, crankcase, and pistons, and limits infusion of air into the oil in the oil pan 24.

The windage tray 80 fits within a flange or lip 54 of the oil pan 24. The windage tray 80 may comprise a plurality of tabs which are received within corresponding pockets formed in the flange or lip 54. Alternately, the windage tray 80 may fit on or within the flange or lip 54 without the use of the tabs and notches. The windage tray 80 has a generally rectangular shape, corresponding to the shape of an opening in the bottom of the engine block 12 and may have a concave surface shape precluding striking by the engine crank. The windage tray 80 may comprise a plurality of edges 82 that generally define the example rectangular shape of the opening 56. The windage tray 80 may also comprise a curved surface which generally follows the curvature of the crank (not shown). As noted, in some embodiments, the edges 82 of the windage tray 80 may comprise a plurality of tabs (not shown) which align with corresponding notches in the flange or lip 54. The tabs may comprise various sizes and shapes, and in some embodiments the sizes and shapes may all be the same or may differ in whole or in part and may be formed so that the windage tray 80 only seats properly in one orientation.

Extending from the forward end 50 of the oil pan 24 is a timing cover 21. The timing cover 21 extends vertically from the front of the lip 54 of the oil pan 24 and provides a location for connection of various accessories, either directly or indirectly. The timing cover 21 extends along the forward end 50 of the oil pan 24 and may extend partially rearwardly along the upper edges of sidewalls 57 of the oil pan 24.

Disposed at the inside or rear of the timing cover 21, the oil pump 30 is shown connected. The oil pump 30 is also connected to and in fluid communication with oil conduits or oil passages 64 (FIG. 5) in the oil pan 24. The oil pump 30 is a direct drive system that is connected to the engine crankshaft, rather than the indirectly driven system using chain, sprocket and oil pump drive shaft in the OEM Ford 7.3 L engine.

Figure 3:
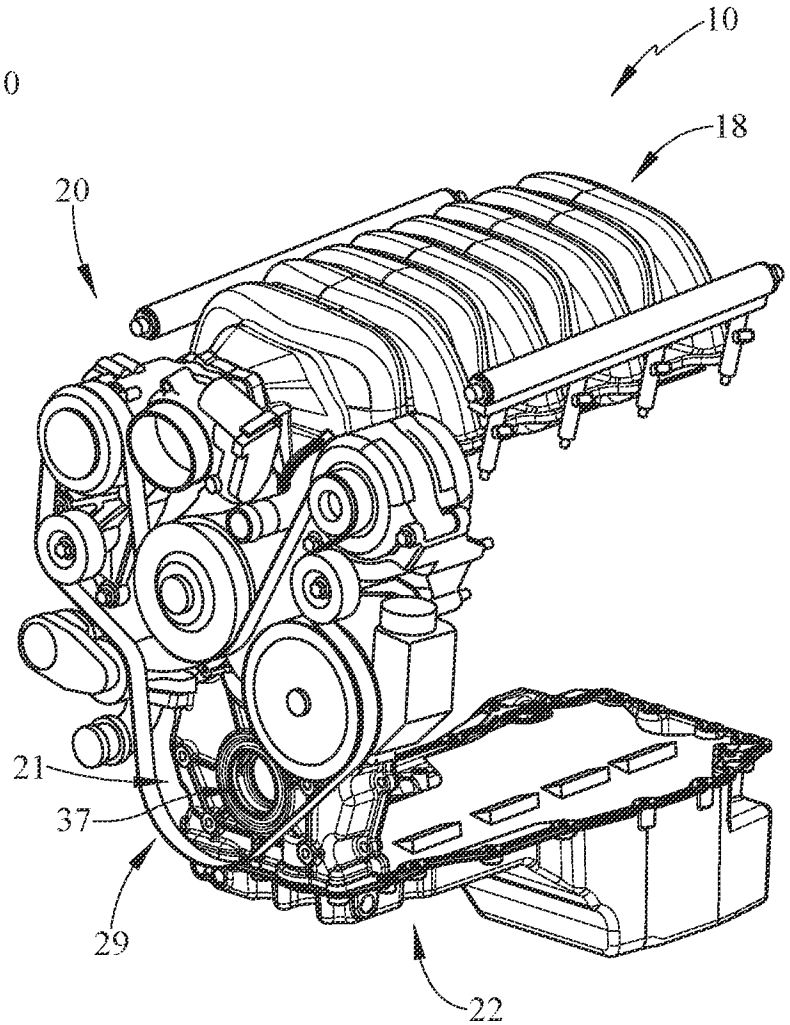
FIG. 3 is a front perspective view of an oiling system of FIG. 2.

With brief reference to FIG. 3, a front perspective view of the oiling system 20 is shown with various accessory devices mounted on the front of the timing cover 21. For example, an accessory belt 29 is shown for example to power. Other accessories may be driven and one or more belt tensioners or idler pulleys may also be utilized along the belt 29 path.

The oil pan assembly 22 is shown extending rearwardly from the timing cover 21. With additional reference to FIG. 2, the pump 30 is located on a rear surface of the timing cover 21. In these views, the pump 30 is shown aligned with an aperture 37 in the timing cover 21 so that the crankshaft can extend through the pump 30 and may be supported by the timing cover 21.

In this arrangement, one additional improvement is provided in that the oil pump 30 is located toward the forward end of the engine 10, inside the timing cover 21, rather than rearwardly within the oil pan. As a result the oil pump 30 may be directly driven, via an adapter, rather than via an additional transmission. Since the oil pump transmission is eliminated, the oil pan 24 may be elevated closer to the bottom of the engine block 12 (FIG. 1B), reducing overall height of the assembled engine 10.

Figure 4:
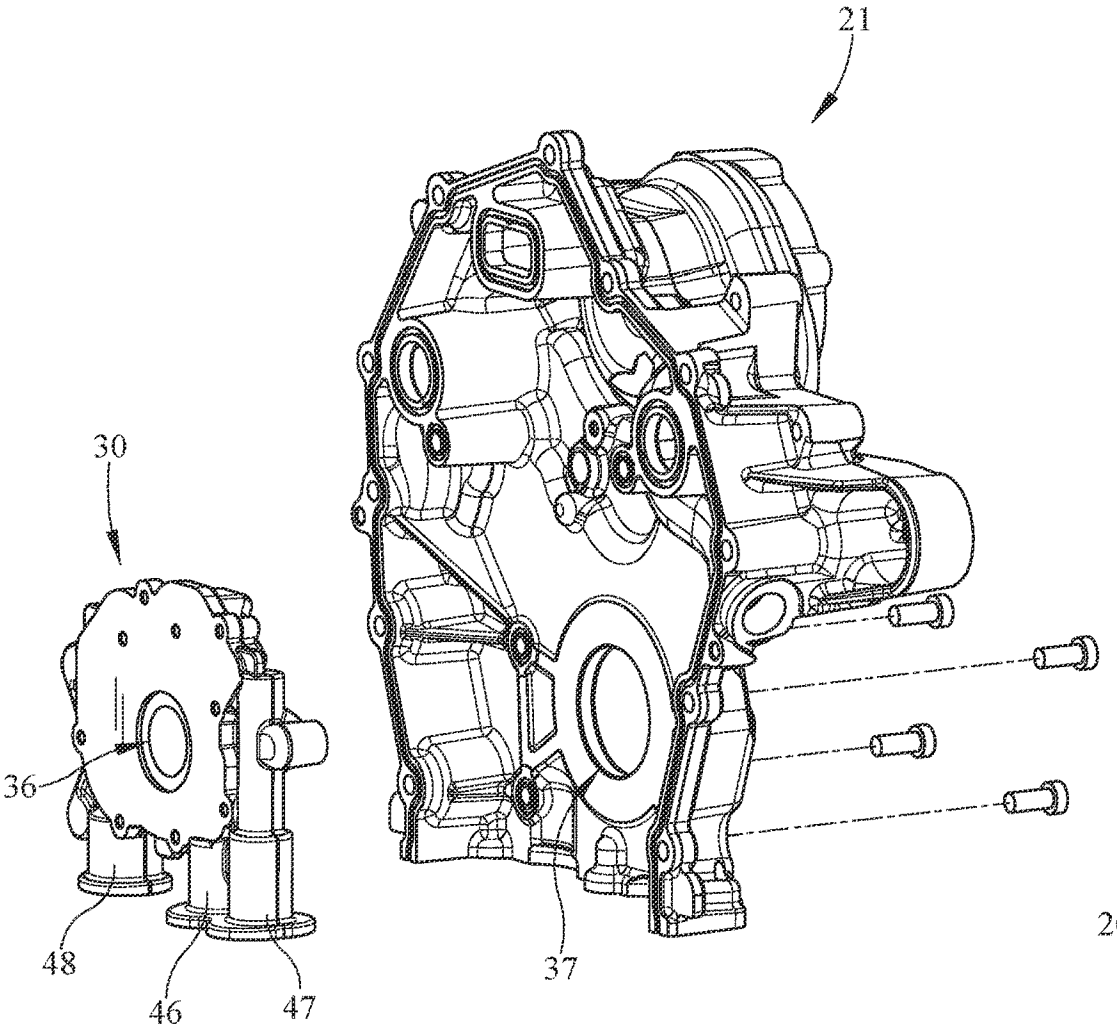
FIG. 4 is a rear perspective view of the timing cover shown with the oil pump exploded therefrom.

Referring now to FIG. 4, a rear perspective view of the timing cover 21 is shown with the oil pump 30 exploded therefrom. The oil pump 30 has three ports 46, 47, 48 at the bottom. The pump 30 has an input port 46 and an output port 47 to receive and output oil flow, respectively. Additionally, an external access port 48 may be provided which may serve multiple functions. The external access port 48 may include a bypass/pressure spring access for adjustment of oil pressure setting.

Figure 5:
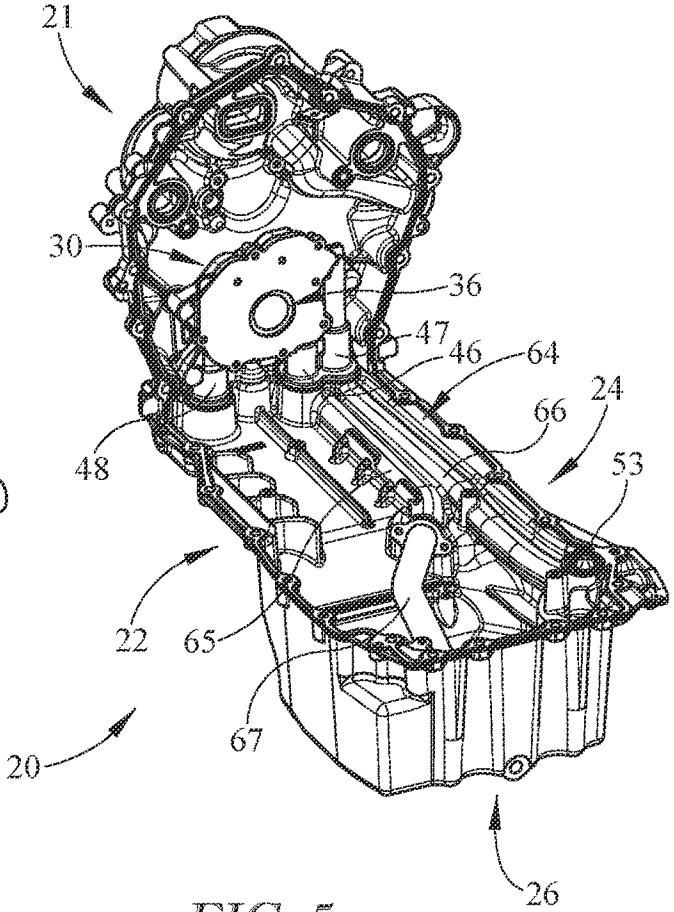
FIG. 5 is a rear perspective view of the oiling system comprising an oil pan assembly and a timing cover of FIG. 3.

Referring now to FIG. 5, a further rear perspective view of the oil pan 24 from a different angle than FIG. 2 and with the windage tray 80 removed. In flow communication with the input port 46 and output port 47 are the conduits 64. At least two conduits 64 are formed integrally with the oil pan 24. One of the conduits or passages 65 extends from the oil pump 30 and defines an oil input or intake from the sump 26. The intake conduit 65 may extend from the sump 26 to the pump 30, or may extend partially and use a removable conduit 67 to extend some portion of the distance from the end of the integral portion to the sump 26. An output conduit or passage 66 from the pump 30 may include one or more conduits. In the instant embodiment, the output conduit 66 extends from the pump output 47 to the oil filter mount 62 (FIG. 2) and/or to a rear engine feed port, via one or more conduits. The input connection 46 is connected to the input conduit or passage 65 and the output connection 47 is connected to the output conduit or passage 66.

The view shows the oil pump 30 and the conduits 64 disposed relative to the oil pan 24. The oil pump 30 is shown mounted to the rear side of the timing cover 21. In this embodiment, the rear sump 26 location is remote from the pump 30. Accordingly, conduits 64 are shown extending from the rear sump 26 to the oil pump 30. In this orientation, the pump 30 is shown with the pump input 46 and a pump output 47 on the right hand side of the pump 30. The oil pump 30 input pulls oil from the sump 26 via the conduits 64 to the oil pump 30. The oil pump 30 output receives oil from the oil sump 26 and moves oil to the engine block and an oil filter. A rear feed port 53 is located near the oil filter 60. The rear feed port 53 may feed oil to the rear of the engine 10.

Also shown in this view, the oil pump 30 may be directly driven by the engine crankshaft (not shown). As depicted, the oil pump 30 has a central aperture 36 which receives the crankshaft and is aligned with an aperture 37 in the timing cover 21. On the forward side of the timing cover 21, a crankshaft pulley may be located which operably cooperates with the accessory belt 29 previously described.

Figure 6:
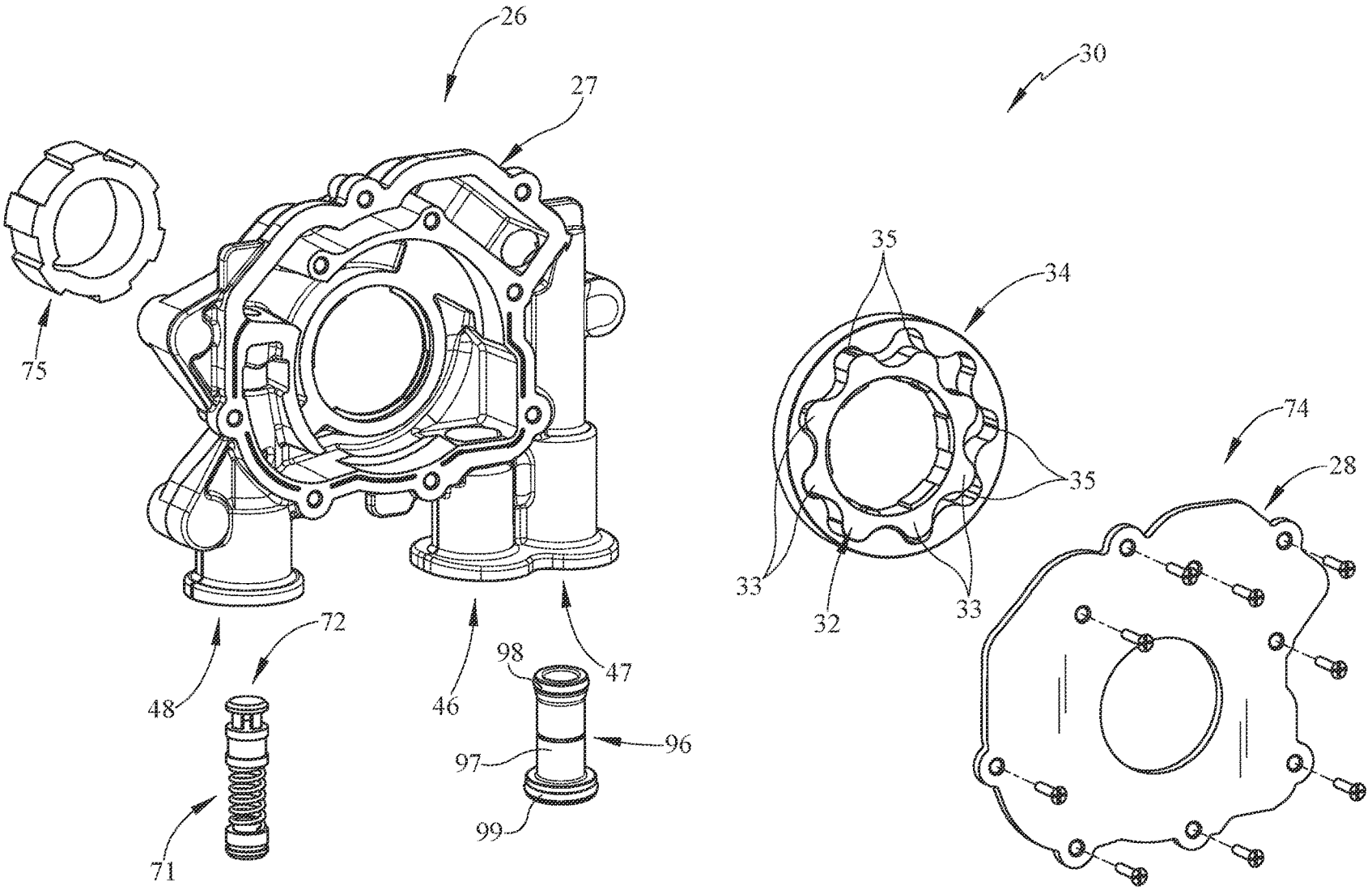
FIG. 6 is an exploded view of the instant oil pump assembly according to present embodiments; and, FIG. 7 is a perspective view of an example oil pan of the oiling system with the optional windage tray removed.

Referring now to FIG. 6, an exploded perspective view of the oil pump 30 is shown. The oil pump 30 may be a gerotor, or generated rotor, pump. The pump 30 may, for example, comprise an inner rotor 32 and an outer rotor 34 wherein the axis of inner rotor is offset from the axis of the outer rotor.

The oil pump 30 fits generally behind and within the timing cover 21. The oil pump 30 comprises a housing 27 which comprises first and second conduits 46, 47 corresponding to input and output for oil. Additionally, the access for the pump spring 71 and pressure control piston 72 may also be provided at the port 48. The housing 27 includes at least one conduit which pressurizes to pull oil to the pump via the input 46 and to push oil from the output 47.

Exploded from the pump housing 27 is the spring 71 and a pressure control piston 72. When the pump 30 is assembled, the pressure control piston 72 is located in a position corresponding to the port 48.

Adjacent to the pressure control piston 72 is an external rotor 34 and internal rotor 32. The two rotors 32, 34 are shown seated adjacent to one another. The external rotor 34 has a plurality of sockets 35 located along an inner radial periphery. The internal rotor 32 has a plurality of teeth 33 which engage the sockets 35 during rotation. The two rotors have offset center axes for eccentric movement of the external rotor 34 relative to the internal rotor 32. During rotation, the pump spring 71 and pressure control piston 72 move to pressurize the oil system.

A housing cover 74 is also shown exploded from the housing. The internal and external rotors 32, 34 and the pressure control piston 72 are disposed in the housing 27. The housing cover 28 is then fastened to the housing 27.

On the opposite side of the oil pump housing, an adapter 75 is provided. The adapter 75 operably connects the crankshaft to the oil pump 30 by aligning the pump 30 with the crankshaft and receiving the crankshaft. The radial outer surface of the adapter 75 comprises a plurality of teeth or gaps which engages the opposed teeth or gaps along the inner radial surface of the inner rotor 32. Thus, as the crankshaft rotates, the adapter 75 drives rotation of the internal rotor 32 is driven too. Additionally, the rotation of the crankshaft causes rotation of the oil pump 30 at the same speed as the engine due to the direct drive arrangement. In some other embodiments, it may be desirable to have an indirect drive though, for example, a transmission such as a gearbox to change the speed of the oil pump.

Also shown in this view exploded from the housing 27, is an oil transfer tube 96. The oil transfer tube 96 is disposed within the output port 47 and provides a rigid structure capable of sealing the connection between the oil pan 24 and the oil pump housing 27. The oil transfer tube 96 comprises a flow path 97 disposed between a first seal 98 and a second seal 99. Because the oil transfer tube 96 is rigid, it can withstand the higher pressures at the output of the oil pump housing 27. Further however, the ends of the tube 96 includes the seals 98, 99, such as O-rings, which engage within the output port 47 and a corresponding port of the oil pan 24. The oil transfer tube 96 comprises a slip-fit arrangement, which is similar to a pipe-in-pipe configuration and allows for improved handling of stacking tolerances. Further however, as an alternative to the oil transfer tube 96, the one or more ports of the pan 24 and housing 27 may comprise O-rings at the interfaces of the oil pump housing and oil pan.

Figure 7:
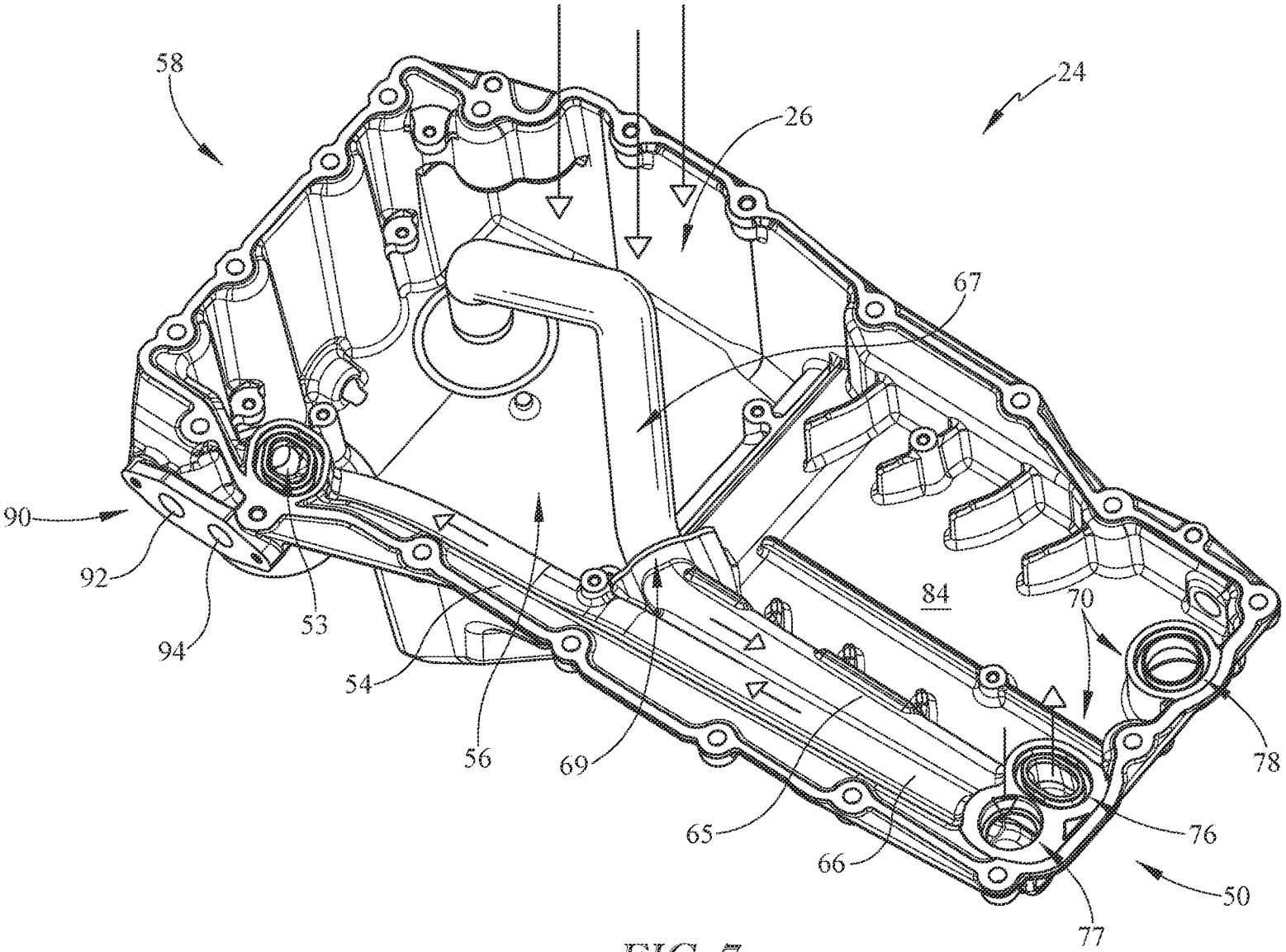

Referring now to FIG. 7, a perspective view of an example oil pan 24. The oil pan 24 comprises the forward end 50 and rear end 58. The oil pan 24 further comprises the flange or lip 54 which surrounds the opening 56 wherein oil returns from fluid flow through the engine 10 (FIG. 2).

At the forward end 50 of the oil pan 24, there are three connections to the oil pump 30. The oil pan 24 comprises an oil input connection 77 which receives oil from the pump. The oil pan 24 comprises an output connection 76 which provides oil input to the oil pump from the sump 26. Additionally, the oil pan 24 comprises an access port 78 which is in communication with the pump port 48, in order to access the pressure control piston 72 and vary pressure of the oil pump 26.

The oil pan 24 has an upper oil floor 84 toward the forward end 50 and the sump 26 to the rear end 58. However, the sump 26 may also be a mid or forward sump in other embodiments. The floor 84 is disposed at a different elevation than the sump 26. The floor 84 may also be tilted or slanted to direct oil flow toward to the sump 26.

The passage 65 is shown extending from the connection 76 toward the sump 26. The passage 65 may be partially cast in and additionally comprise a bolt-in extension 69 that drops into the sump 26 defining a suction inlet. The passage 66 may be cast-in and extends between the pump and an engine feed port 53.

The oil pan 24 has a reduced height versus the prior art oil pan of FIG. 1. Accordingly, the height from the bottom of the oil pan 24 to the engine crankshaft (when installed) is decreased. This allows the engine 10 to be positioned lower in the engine compartment and eliminate or reduce the need for hood modifications.

The oil pan 24 further comprises a flange 90 with first and second ports 92, 94. One of the ports 92, 94 allows for connection and directing of oil to an oil cooler, if utilized. Alternately, if the oil cooler is not utilized or needed, the ports may define a loop so that oil exits one port and returns in the other for feeding to the engine.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. An oiling system for a combustion engine, comprising:

a timing cover;

an oil pump which is mounted to said timing cover, said oil pump being a gerotor pump that is configured to be directly driven by a crankshaft;

said oil pump having an oil input, an oil output port adjacent to said oil input, and an external access port which allows for pressure adjustment therein;

an oil pan having a first end connected to a lower edge of said timing cover, a second end defining a sump, and integrally formed oil passages located between said first end and said second end, wherein said oil passages include an input passage and an output conduit; and said oil pump disposed adjacent to said first end of said oil pan and in fluid communication with said oil passages.

2. The oiling system of claim 1, further comprising said oil passages being cast-in oil passages in the oil pan.

3. The oiling system of claim 2, said cast-in oil passages in flow communication with ports of said oil pump.

4. The oiling system of claim 3, further comprising a gasket disposed between said ports of said oil pump and cast-in passages of said oil pan.

5. The oiling system of claim 1, said oil pump disposed on a rear side of said timing cover.

6. The oiling system of claim 1 further comprising said external access port formed in said oil pump and aligned with an access port in said oil pan.

7. The oiling system of claim 1, said oil pan having the external access for an oil pump pressure control spring in said external access port of said oil pump.

8. The oiling system of claim 1, said oil pump positioned for and capable of being driven by said crankshaft of said combustion engine.

9. The oiling system of claim 1, said oil pump being directly driven by said crankshaft.

10. The oiling system of claim 9, further comprising an adapter positioned within said oil pump and capable of receiving said crankshaft.

11. The oiling system of claim 10, said adapter causing rotation of said oil pump at a same speed of said crankshaft.

12. The oiling system of claim 1, said combustion engine being a FORD 7.3L gasoline engine.

13. The oiling system of claim 1, further comprising a drive on said crankshaft and engaging said oil pump.

14. The oiling system of claim 1, said oil pump comprising a housing and first and second internal rotors.

15. The oiling system of claim 1, said oil pan further comprising a windage tray.

16. A method of installing an oiling system, comprising the steps of:

removing a first oil pan and a first timing cover from a combustion engine having a first oil pump spaced from said first timing cover toward a rear of said first oil pan;

installing a second oil pump to a second timing cover toward a front of a second oil pan, said second oil pan having a reduced depth dimension, and said second oil pump having an input port, an output port and an external access port for pressure adjustment;

connecting said second oil pump to ports in said second oil pan, said ports being in fluid communication with integrally formed oil passages in said second oil pan, and said oil passages comprising an input passage and an outlet passage; and installing said second oil pan to said combustion engine to provide a reduction in total height of the combustion engine, wherein the input port and output port are adjacent to each other, and wherein the second oil pump is a gerotor pump that is directly driven by a crankshaft of the engine.

17. The method of claim 16, said combustion engine being a FORD 7.3L gasoline engine.

18. The method of claim 16, said oiling system being a front drive system.

* * * * *